US009213269B2

(12) United States Patent
Kato et al.

(10) Patent No.: US 9,213,269 B2
(45) Date of Patent: Dec. 15, 2015

(54) DEVELOPING DEVICE AND IMAGE FORMING APPARATUS

(71) Applicant: FUJI XEROX CO., LTD., Tokyo (JP)

(72) Inventors: Masanori Kato, Kanagawa (JP); Nobumasa Furuya, Kanagawa (JP); Jun Abe, Kanagawa (JP); Sakae Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 30 days.

(21) Appl. No.: 13/752,851

(22) Filed: Jan. 29, 2013

(65) Prior Publication Data

US 2014/0023408 A1 Jan. 23, 2014

(30) Foreign Application Priority Data

Jul. 19, 2012 (JP) ..... 2012-160365

(51) Int. Cl.
*G03G 15/09* (2006.01)
*G03G 15/08* (2006.01)

(52) U.S. Cl.
CPC ..... *G03G 15/0928* (2013.01); *G03G 15/0818* (2013.01); *G03G 2215/0648* (2013.01)

(58) Field of Classification Search
CPC ..... G03G 15/0928; G03G 15/0818; G03G 2215/0648
USPC ..... 399/269, 276, 279
See application file for complete search history.

(56) References Cited

U.S. PATENT DOCUMENTS

| | | | | |
|---|---|---|---|---|
| 2004/0091278 | A1* | 5/2004 | Serizawa et al. | 399/55 |
| 2006/0008300 | A1* | 1/2006 | Tanaka | 399/269 |
| 2011/0229215 | A1* | 9/2011 | Hirota et al. | 399/269 |
| 2013/0108328 | A1* | 5/2013 | Ariizumi | 399/276 |
| 2013/0136506 | A1* | 5/2013 | Sakamaki | 399/269 |

FOREIGN PATENT DOCUMENTS

| | | |
|---|---|---|
| JP | A 2004-85631 | 3/2004 |
| JP | A 2006-53198 | 2/2006 |

* cited by examiner

*Primary Examiner* — Ryan Walsh
(74) *Attorney, Agent, or Firm* — Oliff PLC

(57) ABSTRACT

There is provided a developing device including a first developing roller that is disposed to be rotatable with a desired distance set between the first developing roller and an outer circumferential surface of a rotatable latent image holding member, transports a developer onto an outer circumferential surface thereof while holding the developer by magnetic force, and has a substantially cylindrical shape, and a second developing roller that is disposed to be rotatable with desired distances set between the second developing roller and the respective outer circumferential surfaces of the corresponding latent image holding member and the corresponding first developing roller at a position on the downstream side of the first developing roller in a rotation direction of the latent image holding member, transports the developer onto an outer circumferential surface thereof while holding the developer by magnetic force, and has a substantially cylindrical shape.

14 Claims, 15 Drawing Sheets

FIG. 7

| NUMBER OF GROOVES (NUMBER) | | CIRCUMFERENTIAL SPEED RATIO TO PHOTOCONDUCTOR DRUM (mm) | | COMPUTATIONAL GROOVE PITCH (mm) | | FIRST | | SECOND | | |
|---|---|---|---|---|---|---|---|---|---|---|
| | | | | | | DEVELOP-ING ABILITY | JAMM-ING RESIS-TANCE | GROOVE PITCH UNEVEN-NESS | SMOOTH-ING EFFECT | TRIMMER STRESS |
| FIRST | SECOND | FIRST | SECOND | FIRST | SECOND | | | | | |
| 100 | 100 | 1.2 | 1.2 | 0.65 | 0.65 | 1.10 | ○ | × | × | ○ |
| 100 | 100 | 1.2 | 1.5 | 0.65 | 0.52 | 1.10 | ○ | × | ○ | △ |
| 100 | 100 | 1.2 | 1.8 | 0.65 | 0.44 | 1.10 | ○ | ○ | ○ | × |
| 100 | 100 | 1.5 | 1.2 | 0.52 | 0.65 | 1.38 | ○ | × | × | ○ |
| 100 | 100 | 1.5 | 1.5 | 0.52 | 0.52 | 1.38 | ○ | × | × | △ |
| 100 | 100 | 1.5 | 1.8 | 0.52 | 0.44 | 1.38 | ○ | ○ | ○ | × |
| 100 | 100 | 1.8 | 1.2 | 0.44 | 0.65 | 1.65 | ○ | × | × | ○ |
| 100 | 100 | 1.8 | 1.5 | 0.44 | 0.52 | 1.65 | ○ | × | × | △ |
| 100 | 100 | 1.8 | 1.8 | 0.44 | 0.44 | 1.65 | ○ | ○ | × | × |
| 100 | 130 | 1.2 | 1.2 | 0.65 | 0.50 | 1.10 | ○ | × | ○ | ○ |
| 100 | 130 | 1.2 | 1.5 | 0.65 | 0.40 | 1.10 | ○ | ○ | ○ | △ |
| 100 | 130 | 1.2 | 1.8 | 0.65 | 0.34 | 1.10 | ○ | ○ | ○ | × |
| 100 | 130 | 1.5 | 1.2 | 0.52 | 0.50 | 1.38 | ○ | × | ○ | ○ |
| 100 | 130 | 1.5 | 1.5 | 0.52 | 0.40 | 1.38 | ○ | ○ | ○ | △ |
| 100 | 130 | 1.5 | 1.8 | 0.52 | 0.34 | 1.38 | ○ | ○ | ○ | × |

(CONT.)

(FIG. 7 Continued)

| | | | | | | | | | | |
|---|---|---|---|---|---|---|---|---|---|---|
| 100 | 130 | 1.8 | 1.2 | 0.44 | 0.50 | 1.65 | ○ | × | × | ○ |
| 100 | 130 | 1.8 | 1.5 | 0.44 | 0.40 | 1.65 | ○ | ○ | ○ | △ |
| 100 | 130 | 1.8 | 1.8 | 0.44 | 0.34 | 1.65 | ○ | ○ | ○ | × |
| 100 | 160 | 1.2 | 1.2 | 0.65 | 0.41 | 1.10 | ○ | ○ | ○ | ○ |
| 100 | 160 | 1.2 | 1.5 | 0.65 | 0.33 | 1.10 | ○ | ○ | ○ | △ |
| 100 | 160 | 1.2 | 1.8 | 0.65 | 0.27 | 1.10 | ○ | ○ | ○ | × |
| 100 | 160 | 1.5 | 1.2 | 0.52 | 0.41 | 1.38 | ○ | ○ | ○ | ○ |
| 100 | 160 | 1.5 | 1.5 | 0.52 | 0.33 | 1.38 | ○ | ○ | ○ | △ |
| 100 | 160 | 1.5 | 1.8 | 0.52 | 0.27 | 1.38 | ○ | ○ | ○ | × |
| 100 | 160 | 1.8 | 1.2 | 0.44 | 0.41 | 1.65 | ○ | ○ | ○ | ○ |
| 100 | 160 | 1.8 | 1.5 | 0.44 | 0.33 | 1.65 | ○ | ○ | ○ | △ |
| 100 | 160 | 1.8 | 1.8 | 0.44 | 0.27 | 1.65 | ○ | ○ | ○ | × |
| 130 | 130 | 1.2 | 1.2 | 0.50 | 0.50 | 1.05 | △ | × | × | ○ |
| 130 | 130 | 1.2 | 1.5 | 0.50 | 0.40 | 1.05 | △ | ○ | ○ | △ |
| 130 | 130 | 1.2 | 1.8 | 0.50 | 0.34 | 1.05 | △ | ○ | ○ | × |
| 130 | 130 | 1.5 | 1.2 | 0.40 | 0.50 | 1.31 | △ | × | × | ○ |
| 130 | 130 | 1.5 | 1.5 | 0.40 | 0.40 | 1.31 | △ | ○ | × | △ |
| 130 | 130 | 1.5 | 1.8 | 0.40 | 0.34 | 1.31 | △ | ○ | ○ | × |
| 130 | 130 | 1.8 | 1.2 | 0.34 | 0.50 | 1.58 | △ | × | × | ○ |
| 130 | 130 | 1.8 | 1.5 | 0.34 | 0.40 | 1.58 | △ | ○ | × | △ |
| 130 | 130 | 1.8 | 1.8 | 0.34 | 0.34 | 1.58 | △ | ○ | × | × |
| 130 | 160 | 1.2 | 1.2 | 0.50 | 0.41 | 1.05 | △ | ○ | ○ | ○ |
| 130 | 160 | 1.2 | 1.5 | 0.50 | 0.33 | 1.05 | △ | ○ | ○ | △ |
| 130 | 160 | 1.2 | 1.8 | 0.50 | 0.27 | 1.05 | △ | ○ | ○ | × |

(CONT.)

(FIG. 7 Continued)

| | | | | | | | | | | |
|---|---|---|---|---|---|---|---|---|---|---|
| 130 | 160 | 1.5 | 1.2 | 0.40 | 0.41 | 1.31 | △ | ○ | × | ○ |
| 130 | 160 | 1.5 | 1.5 | 0.40 | 0.33 | 1.31 | △ | ○ | ○ | △ |
| 130 | 160 | 1.5 | 1.8 | 0.40 | 0.27 | 1.31 | △ | ○ | ○ | × |
| 130 | 160 | 1.8 | 1.2 | 0.34 | 0.41 | 1.58 | △ | ○ | × | ○ |
| 130 | 160 | 1.8 | 1.5 | 0.34 | 0.33 | 1.58 | △ | ○ | ○ | △ |
| 130 | 160 | 1.8 | 1.8 | 0.34 | 0.27 | 1.58 | △ | ○ | ○ | × |
| 160 | 160 | 1.2 | 1.2 | 0.41 | 0.41 | 1.00 | × | ○ | × | ○ |
| 160 | 160 | 1.2 | 1.5 | 0.41 | 0.33 | 1.00 | × | ○ | ○ | △ |
| 160 | 160 | 1.2 | 1.8 | 0.41 | 0.27 | 1.00 | × | ○ | ○ | × |
| 160 | 160 | 1.5 | 1.2 | 0.33 | 0.41 | 1.25 | × | ○ | × | ○ |
| 160 | 160 | 1.5 | 1.5 | 0.33 | 0.33 | 1.25 | × | ○ | × | △ |
| 160 | 160 | 1.5 | 1.8 | 0.33 | 0.27 | 1.25 | × | ○ | ○ | × |
| 160 | 160 | 1.8 | 1.2 | 0.27 | 0.41 | 1.50 | × | ○ | × | ○ |
| 160 | 160 | 1.8 | 1.5 | 0.27 | 0.33 | 1.50 | × | ○ | × | △ |
| 160 | 160 | 1.8 | 1.8 | 0.27 | 0.27 | 1.50 | × | ○ | × | × |

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-160365 filed Jul. 19, 2012.

BACKGROUND (i) Technical Field

The present invention relates to a developing device and an image forming apparatus.

(ii) Related Art

The image forming apparatuses such as a printer, copier, facsimile, to which image printing methods such as an electrophotography and an electrostatic printing method are applied, are provided with developing devices each of which develops an electrostatic latent image, formed on the latent image holding member such as a rotatable photoconductor, by using a developer.

In such developing devices, there is a developing device capable of increasing development efficiency by providing plural (for example, two) developing rollers that hold a developer with a magnetic property through magnetic force and transport the developer to a development region which confronts a latent image holding member, by rotation thereof. Here, as the developing roller, for example, a developer holding carrier is used that is constituted of a transport member, which is rotatable and has a substantially cylindrical shape, and a magnet member which is fixedly disposed inside the transport member and generates magnetic force lines for holding the developer on the outer circumferential surface of the transport member through magnetic force.

SUMMARY

According to an aspect of the invention, there is provided a developing device including: a first developing roller that is disposed to be rotatable with a desired distance set between the first developing roller and an outer circumferential surface of a rotatable latent image holding member, transports a developer onto an outer circumferential surface thereof, on which plural grooves extending along an axial direction are formed, while holding the developer by magnetic force, and has a substantially cylindrical shape; and a second developing roller that is disposed to be rotatable with desired distances set between the second developing roller and the respective outer circumferential surfaces of the corresponding latent image holding member and the corresponding first developing roller at a position on the downstream side of the first developing roller in a rotation direction of the latent image holding member, transports the developer onto an outer circumferential surface thereof, on which plural grooves extending along an axial direction thereof are formed, while holding the developer by magnetic force, and has a substantially cylindrical shape, wherein the number of grooves on the second developing roller is larger than the number of grooves on the first developing roller.

BRIEF DESCRIPTION OF THE DRAWINGS

Exemplary embodiments of the present invention will be described in detail based on the following figures, wherein:

FIG. 4A is an explanatory diagram schematically illustrating a configuration of each developing roller, FIG. 4B is a schematic cross-sectional diagram illustrating grooves formed on each developing roller, and FIG. 4C is an explanatory diagram schematically illustrating the configuration of the grooves of FIG. 4B;

FIG. 7 is a table illustrating results of an evaluation test performed by using the developing devices of the respective configurations;

FIG. 8 is a graph illustrating a result obtained when examining the relationship between the computational groove pitch and the actual groove pitch and the like;

DETAILED DESCRIPTION

Hereinafter, a mode for carrying out the invention (hereinafter referred to as an "exemplary embodiment") will be described with reference to the accompanying drawings.

Exemplary Embodiment 1

Figure 1:
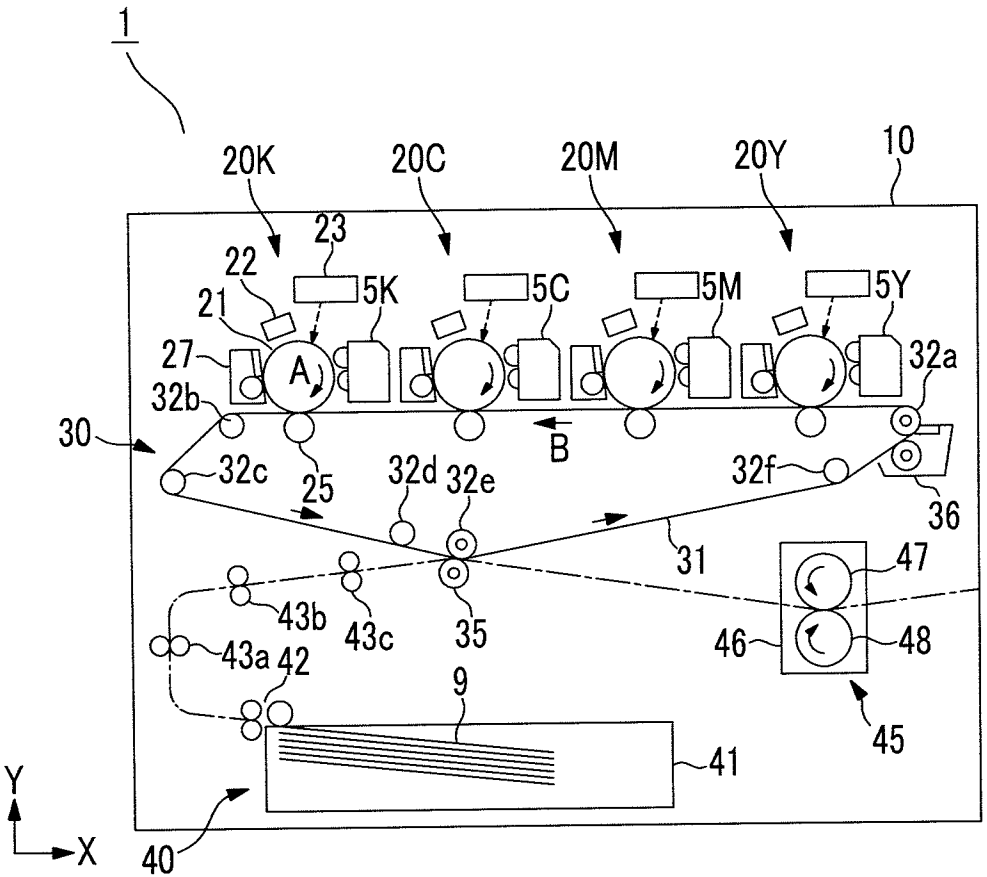
FIG. 1 is an explanatory diagram illustrating an image forming apparatus using a developing device according to an Exemplary Embodiment 1.
Figure 2:
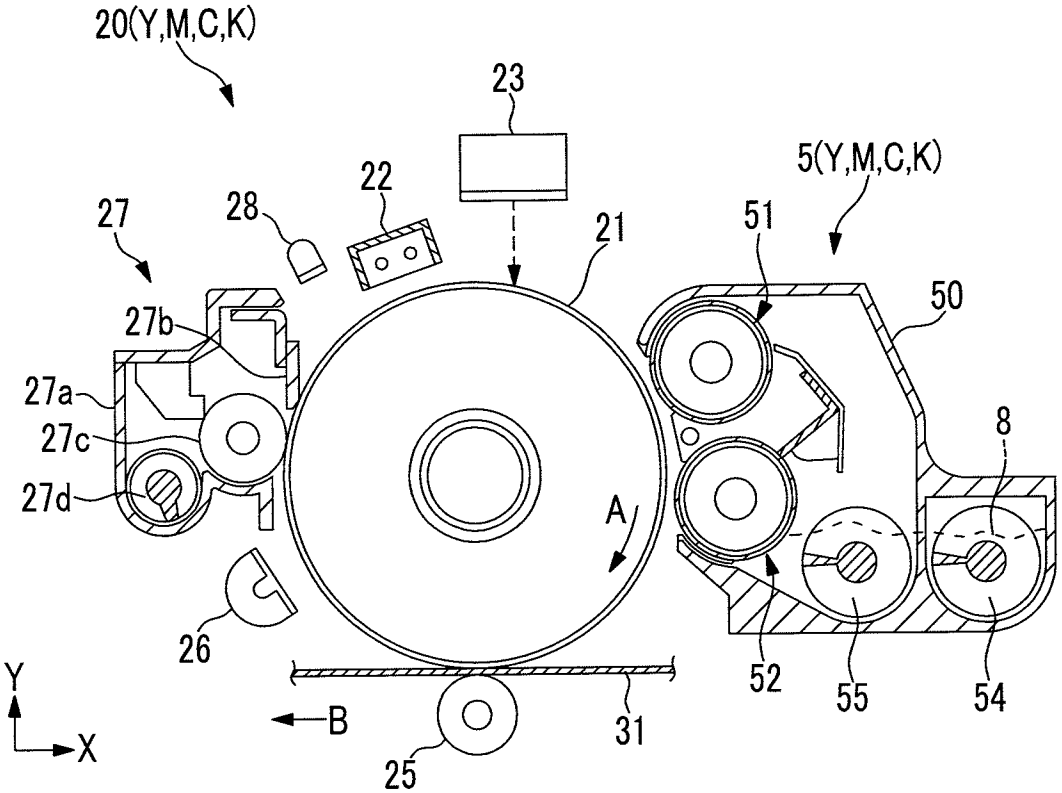
FIG. 2 is a partially cross-sectional explanatory diagram illustrating principal sections (such as an image creating device) in the image forming apparatus of FIG. 1.
Figure 3:
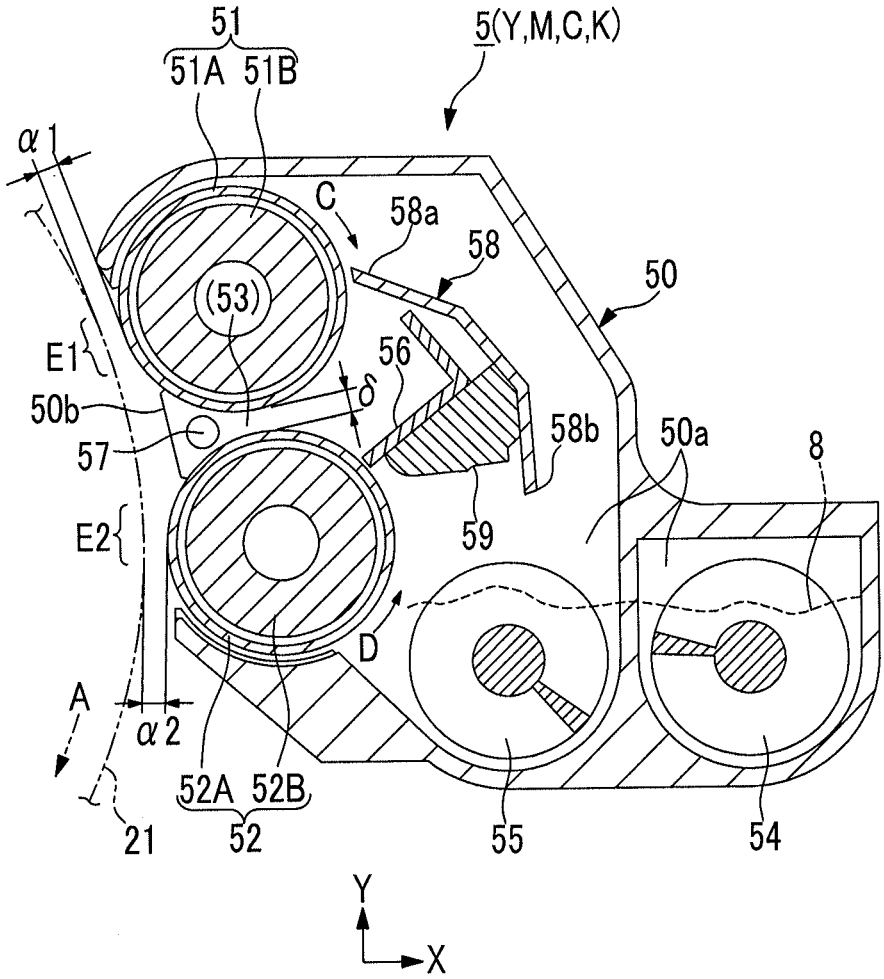
FIG. 3 is a schematic cross-sectional diagram illustrating the developing device used in the image forming apparatus of FIG. 1.

FIGS. 1 to 3 show an image forming apparatus using a developing device according to Exemplary Embodiment 1. FIG. 1 shows a brief overview of the image forming apparatus. FIG. 2 shows principal sections (an image creating device including the developing device) of the image forming apparatus. FIG. 3 shows the developing device.

Overall Configuration of Image Forming Apparatus

The image forming apparatus 1 is formed as, for example, a color printer. Inside a casing 10 of the image forming apparatus 1, there are provided plural image creating devices 20 that form a toner image, which is developed by a toner (for example fine colored powder) constituting a developer, an intermediate transfer device 30 that holds toner images respectively formed on the image creating devices 20 and finally performs secondary transfer of the images onto a printing paper 9 as an example of a printing target member, a sheet feeding device 40 that contains and transports the desired printing paper 9 to be supplied to a secondary transfer section of the intermediate transfer device 30, a fixing device 45 that fixes the toner images by passing the printing paper onto which the toner images are transferred by the intermediate transfer device 30, and the like. A supporting structure section or an exterior section of the casing 10 is formed of a supporting member, an exterior cover, and the like. The chain line in the drawing indicates a principal transport path along which the printing paper 9 is transported in the casing 10.

The image creating devices 20 are formed of four image creating devices 20Y, 20M, 20C, and 20K which form toner images with four colors of yellow (Y), magenta (M), cyan (C), and black (K) respectively dedicated therefor. The four image creating devices 20 (Y, M, C, K) are arranged in series in the inner space of the casing 10. Further, each image creating device 20 (Y, M, C, K) has a substantially common configuration shown as follows, except that the type of the pertinent developer is different.

Each image creating device 20 (Y, M, C, K) includes a rotatable photoconductor drum 21 as shown in FIGS. 1 and 2. Thus, the following devices are principally disposed around the photoconductor drum 21. The principal devices include: a charging device 22 that charges the outer circumferential surface (image holding surface), on which the image of the photoconductor drum 21 can be formed, at a desired electric potential; an exposure device 23 that forms the electrostatic latent image (for each color) by irradiating the outer circumferential surface of the photoconductor drum 21, which is charged, with light based on the information (signal) of the image; a developing device 5 (Y, M, C, K) that develops the electrostatic latent image into a toner image with a toner of the developer of the corresponding color (Y, M, C, K); a primary transfer device 25 that transfers the toner image onto (the intermediate transfer belt of) the intermediate transfer device 30; an uncleaned-state charging device 26 that charges attachments such as the toner which remains on and is adhered onto the outer circumferential surface of the photoconductor drum 21 after the primary transfer; a drum cleaning device 27 that cleans to remove the recharged attachments; a charge remover 28 that removes electric charge from the outer circumferential surface after cleaning of the photoconductor drum 21; and the like.

The photoconductor drum 21 is formed by the image holding surface that has a photoconductive layer (photosensitive layer) made of a photosensitive material on the circumferential surface of the grounded substrate having a substantially cylindrical or columnar shape, and is supported to be rotatable in a direction indicated by the arrow A through power generated from a rotation driving device which is not shown. The charging device 22 is formed as a non-contact-type charging device such as a corona discharger, which is disposed to not be in contact with the photoconductor drum 21, or a contact-type charging device which uses a charging roller and the like disposed to be in contact with the photoconductor drum 21 with a charging voltage supplied. When the developing device 24 performs reversal development with the charging voltage, a voltage or current with a polarity the same as the charge polarity of the toner is supplied from the developing device.

The exposure device 23 irradiates the charged outer circumferential surface of the photoconductor drum 21 with light (the dotted line to which the arrow is attached) which is generated on the basis of the information of the image input to the image forming apparatus 1, thereby forming an electrostatic latent image. The exposure device 23 receives image signals of the respective color components obtained by performing desired image processing through an image processing device, on the information of the image as a printing target which is input to the image forming apparatus 1. The developing device 5 (Y, M, C, K) also uses, for example, a two-component developer 8 including magnetic carriers and a non-magnetic toner corresponding to each of the four colors, and particularly employs two developing rollers 51 and 52 as shown in FIGS. 2 and 3. It should be noted that the developing device 5 will be described later in detail.

The primary transfer device 25 is a contact-type transfer device that has a primary transfer roller which is rotated in contact with the outer circumferential surface of the photoconductor drum 21 and is supplied with a primary transfer voltage. As the primary transfer voltage, a direct-current voltage, which has a polarity inverse to a polarity of the charge of the toner, or the like is applied from a power supply section for transfer, which is not shown. The primary transfer device 25 may constitute the intermediate transfer device 30. The drum cleaning device 27 includes, as shown in FIG. 2: a main member 27*a* that has a container shape of which a part is open; a cleaning plate (cleaning blade) 27*b* that is disposed to come into contact with the outer circumferential surface of the photoconductor drum 21 after the primary transfer with a desired pressure and removes attachments such as remaining toner; a rotatable brush roller 27*c* that is disposed to be rotatable in contact with the outer circumferential surface of the photoconductor drum on the upstream side of the cleaning plate 27*b* in the rotation direction of the photoconductor drum 21 and performs cleaning; a delivery member 27*d* such as a screw auger that is driven to collect the attachments such as the toner removed by the cleaning plate 27*b* and sends the attachments to a collecting system which is not shown; and the like. A plate-like member made of rubber or the like is used as the cleaning plate 27*b*.

The intermediate transfer device 30 is disposed under the respective image creating devices 20 (Y, M, C, K), as shown in FIG. 1. The intermediate transfer device 30 principally includes: an intermediate transfer belt 31 that is rotated in a direction indicated by the arrow B while passing a primary transfer position located between the photoconductor drum 21 and the primary transfer device 25 (primary transfer roller); plural supporting rollers 32*a* to 32*f* that hold and rotatably support the intermediate transfer belt 31 in a desired state at the inside thereof; a secondary transfer device 35 that is rotated in contact with the outer circumferential surface (image holding surface) of the intermediate transfer belt 31, which is supported by a supporting roller 32*e*, with a predetermined pressure; and a belt cleaning device 36 that removes and cleans the attachments such as paper powder and the toner which remains and is adhered onto the outer circumferential surface of the intermediate transfer belt 31 after passing the secondary transfer device 35.

The intermediate transfer belt 31 employs, for example, an endless belt on which resin particles made from polytetrafluoroethylene (PTFE) and the like are distributed in order to apply a capability to release the toner image from the belt base which is formed by distributing a resistance modifier such as carbon black in a synthetic resin such as a polyimide resin and a polyamide resin. Further, the supporting roller 32*a* is formed as a driving roller, the supporting rollers 32*b*, 32*d*, and 32*f* are formed as driven rollers that hold the running positions of the belt or the like, the supporting roller 32*c* is formed as a tensioning roller, and the supporting roller 32*e* is formed as a backup roller of the secondary transfer.

The secondary transfer device 35 includes: a secondary transfer roller that comes into contact with the outer circumferential surface of the intermediate transfer belt 31 supported by the backup roller 32*e* with a desired pressure; and a secondary transfer power supply that supplies a secondary transfer voltage to the backup roller 32*e* or the secondary transfer roller (35) and is not shown in the drawing. As the secondary transfer voltage, a direct-current voltage, of which the polarity is the same as or reverse to the polarity of the charge of the toner is used. The belt cleaning device 36 includes: a cleaning plate (cleaning blade) that is disposed to come into contact with the outer circumferential surface of the intermediate transfer belt 31 after passing the secondary transfer position 35 with a desired pressure and removes attachments such as remaining toner; a rotatable brush that cleans in contact with the outer circumferential surface of the intermediate transfer belt 31 on the upstream side of the cleaning plate in the rotation direction of the belt; and the like. A plate-like member made of rubber or the like is used as the cleaning plate.

The sheet feeding device 40 is disposed to be located under the intermediate transfer device 30. The sheet feeding device 40 principally includes a single (or plural) paper containing member 41 that contains and stacks the sheets of printing paper 9 with a desired size and type such that the sheets can be taken out to the front side (the side facing an operator in use) of the casing 10; and a delivery device 42 that delivers the sheets of printing paper 9 from the paper containing member 41 one by one. The printing paper 9 sent from the sheet feeding device 40 is transported to the secondary transfer position (between the intermediate transfer belt 31 and a secondary transfer belt 351 of the secondary transfer device 35) of the intermediate transfer device 30 through the transport path constituting plural pairs of paper transport rollers 43*a*, 43*b*, 43*c*, . . . and a transport guide member. Further, a transport device, which transports the printing paper 9 after the secondary transfer to the fixing device 45 and is not shown in the drawing, is provided between the secondary transfer device 35 and the fixing device 45.

The fixing device 45 is provided with a heating rotating member 47 that is rotated inside the casing 46 in a direction indicated by the arrow and heats with a heating section such that the surface temperature is held at a predetermined temperature; and a pressing rotating member 48 that is driven to be rotatable in contact with the heating rotating member 47 with a predetermined pressure in the axial direction thereof. The printing paper 9, on which the toner image is completely fixed by the fixing device 45 and the image is formed, is transported to and contained in a discharging section, which is provided in the casing 10 and is not shown in the drawing, through the discharging transport path constituted of plural pairs of transport rollers and a transport guide member.

Basic Operation of Image Forming Apparatus

Next, the basic image formation operation (printing) performed by the image forming apparatus 1 will be described. Here, a description will be given of a pattern of an image formation operation by which a full-color image is formed by combination of the toner images of four colors (Y, M, C, K) using all the four image creating devices 20 (Y, M, C, K).

When a request of the image formation operation (printing) is issued from the image information equipment and the like, in each of the four image creating devices 20 (Y, M, C, K), first by rotating each photoconductor drum 21 in a direction indicated by the arrow A, each charging device 22 charges the image holding surface of each photoconductor drum 21 with a desired polarity (a negative polarity in the exemplary embodiment) and at an electric potential. Subsequently, each exposure device 23 performs exposure on the surface of the charged photoconductor drum 21 by emitting light on the basis of the image data which is decomposed in accordance with each color component (Y, M, C, K) transmitted from the image processing device, thereby forming an electrostatic latent image of each of the color components having desired electric potential differences.

Next, each developing device 5 (Y, M, C, K) supplies the toner with each corresponding color (Y, M, C, K), which is charged with a desired polarity (negative polarity), from the developing rollers 51 and 52 to the electrostatic latent image of each color component formed on the photoconductor drum 21, and electrostatically adheres the toner onto the image. By performing development in such a manner, the electrostatic latent image of each color component formed on each photoconductor drum 21 is developed as a toner image of each of the four colors (Y, M, C, and K) by using the toner with the corresponding color.

Subsequently, respective color toner images, which are formed on the photoconductor drums 21 of the image creating devices 20 (Y, M, C, K), are primarily transferred onto the intermediate transfer belt 31, which is rotated in the direction indicated by the arrow B of the intermediate transfer device 30, by the primary transfer device 25 so as to be sequentially superposed upon one another. The photoconductor drum 21 subjected to the primary transfer in each image creating device 20 is removed and cleaned by the drum cleaning device 27 after the attachments such as the toner remaining on the outer circumferential surface are recharged by the charging device 26 before cleaned, and thereafter the charge of the cleaned outer circumferential surface is removed by the charge remover 28.

Subsequently, after transporting the toner images primarily transferred onto the intermediate transfer belt 31 to the secondary transfer position, the intermediate transfer device 30 collectively secondarily transfers the toner images, which are formed on the intermediate transfer belt 31 at the secondary transfer position, onto the paper 9 which is transported from the sheet feeding device 40. The intermediate transfer belt 31 subjected to the secondary transfer is cleaned by causing the belt cleaning device 36 to remove the attachments such as the toner remaining the outer circumferential surface.

Finally, the printing paper 9, onto which the toner images are secondarily transferred, is released from the intermediate transfer belt 31, is thereafter transported and put into the fixing device 45, and is subjected to a desired fixing process (heat and pressure) of the fixing device 45, whereby unfixed toner images are fixed onto the paper 9. The completely fixed printing paper 9 is discharged to and contained in, for example, a discharging containing section, which is not shown in the drawing, formed in the casing 10 at the time of the image formation operation for forming an image on one surface of the paper.

Through the operation described hitherto, the printing paper 9, on which the full-color image is formed by combination of the four-color toner images, is discharged to the outside of the casing 10.

Configuration of Developing Device

Next, the developing device 5 will be described in detail.

As shown in FIGS. 2 to 4 and the like, the developing device 5 includes a main member 50 that has a containing space 50*a*, which contains the above-mentioned two-component developer 8, and a substantially rectangular opening portion 50*b* which is formed to be opposed to the photoconductor drum 21. The main member 50 has an elongated container shape of which the length is greater than the length of the photoconductor drum 21 in the axial direction. Further, in the containing space 50*a*, transport paths (groove portion) of two substantially parallel lines, which are partitioned by the center partition wall along the length direction of the elongated container shape, are formed, and thus a circulatory transport path, in which the two-line transport paths are connected to each other at both end portions so as to be circulated once, is formed. Only a desired volume of two-component developer G is contained in the containing space 50*a*.

In addition, as shown in FIG. 3 and the like, in the main member 50 of the developing device 5, there are provided: two developing rollers 51 and 52 (a first developing roller 51 and a second developing roller 52) that transport the two-component developer 8 to development regions E1 and E2, which face the photoconductor drum 21 at two positions, while holding the developer with magnetic force; two screw augers 54 and 55 as stirring transport members that stir and transport the two-component developer 8 which is contained in the containing space 50*a*; a layer regulating plate 56 that regulates passage of the two-component developer 8 supplied from a screw auger 55 to the second developing roller 52 so as to regulate the height (the volume of developer transported) of the layer of the developer; a leakproof member 57 that prevents the developer (cloud developer), which floats between the first developing roller 51 and the second developing roller 52, from leaking out of the main member through the opening portion 50*b* of the main member 50; a collection guide plate 58 that guides the developer G, which is released from the first developing roller 51, so as to return the developer to the containing space 50*a*; and the like.

The first developing roller 51 and the second developing roller 52 are provided to be rotated in the desired directions C and D respectively in a state where the rollers are partially exposed to the opening portion 50*b* of the main member 50. The two developing rollers 51 and 52 are disposed with desired distances $\alpha 1$ and $\alpha 2$ set in a rotation direction A of the photoconductor drum 21, and both developing rollers 51 and 52 are also disposed with a gap $\delta$ open. The section (space), in which the two developing rollers 51 and 52 are in closest proximity to each other, is formed as a narrowest gap 53.

The first developing roller 51 of the rollers includes a substantially cylindrical sleeve 51A that is supported to be rotatable in the direction of the arrow C with the desired distance $\alpha 1$ set in the first development region E1 on the outer circumferential surface of the photoconductor drum 21; and a magnet roller 51B that is provided to be fixed onto the inside of the sleeve 51A. The rotation direction C of the sleeve 51A is set such that the movement direction thereof in the first development region E1 of the photoconductor drum 21 is the reverse of the rotation (movement) direction A of the photoconductor drum 21.

In contrast, the second developing roller 52 includes a substantially cylindrical sleeve 52A that is supported to be rotatable in the direction of the arrow D with the desired distance $\alpha 2$ set in the second development region E2 on the downstream side of the first development region E1 on the outer circumferential surface of the photoconductor drum 21; and a magnet roller 52B that is provided to be fixed onto the inside of the sleeve 52A. The rotation direction D of the sleeve 52A is set such that the movement direction thereof in the second development region E2 of the photoconductor drum 21 is the same as the rotation (movement) direction A of the photoconductor drum 21.

Figure 4A:
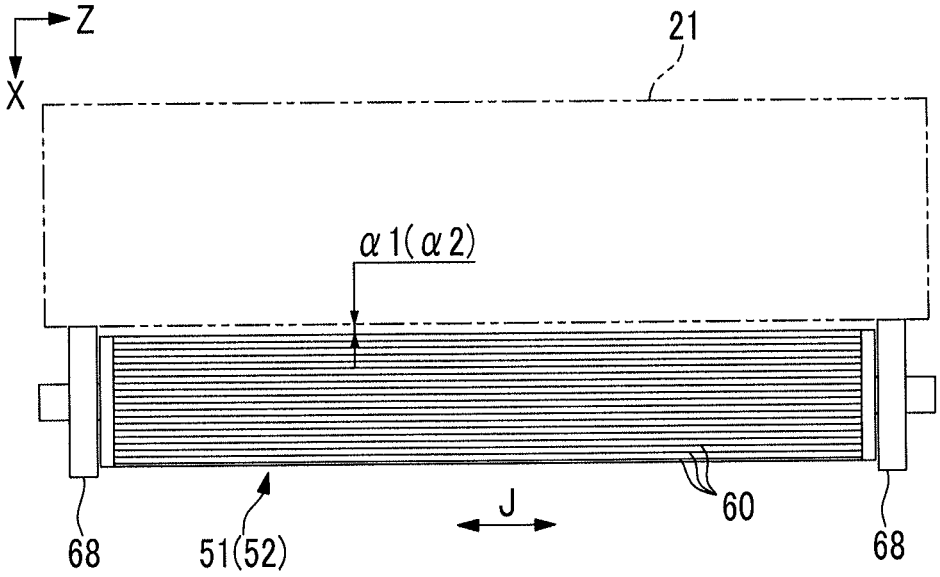
FIGS. 4A to 4C are explanatory diagrams illustrating configurations of two developing rollers in the developing device of FIG. 3 and illustrating a configuration of grooves formed on each developing roller and the like, where
Figure 4B:
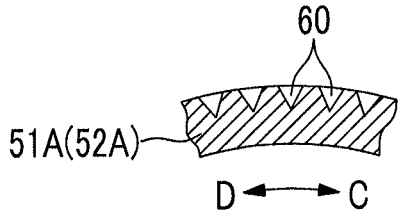
Figure 4C:
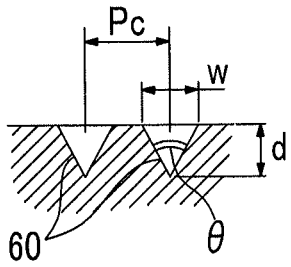

Each of the sleeves 51A and 52A is made of a non-magnetic material (for example, stainless, aluminum, or the like), and is formed in a shape which at least has a cylinder section with a width (length) substantially the same as that of the effective area for image formation in the direction of the rotation shaft of the photoconductor drum 21. Further, as shown in FIGS. 4A to 4C, plural grooves 60, each of which extends in a straight line shape along an axial direction J, are formed on the outer circumferential surface of each of the sleeves 51A and 52A. The grooves 60 will be described in detail later.

Further, as shown in FIGS. 4A to 4C, the shaft portions of each of the sleeves 51A and 52A are formed at both end portions. Distance-keeping rings (tracking rollers) 68, each of which is larger in the dimensions of the distance $\alpha 1$ or $\alpha 2$ than the outer circumferential surface of each sleeve, are mounted on the shaft portions at the both ends of the sleeve. Each shaft portion is rotatably supported by a bearing from the side of the main member 50 so as to be rotatable in a state where each distance-keeping ring 68 is pressed to the outer circumferential surface of the photoconductor drum 21 with a desired pressure. Furthermore, the sleeves 51A and 52A are respectively rotated at desired circumferential speeds in the directions, which are indicated by the arrows C and D, by desired rotational moving force received from a rotation driving device or the like, which is not shown in the drawing, at one end portion of each shaft portion. Furthermore, each of the sleeves 51A and 52A is supplied with a developing voltage for forming a development field between the photoconductor drum 21 and a power feeding device which is not shown. For example a direct current voltage, in which alternating-current components are superposed, is applied as the developing voltage.

Figure 5:
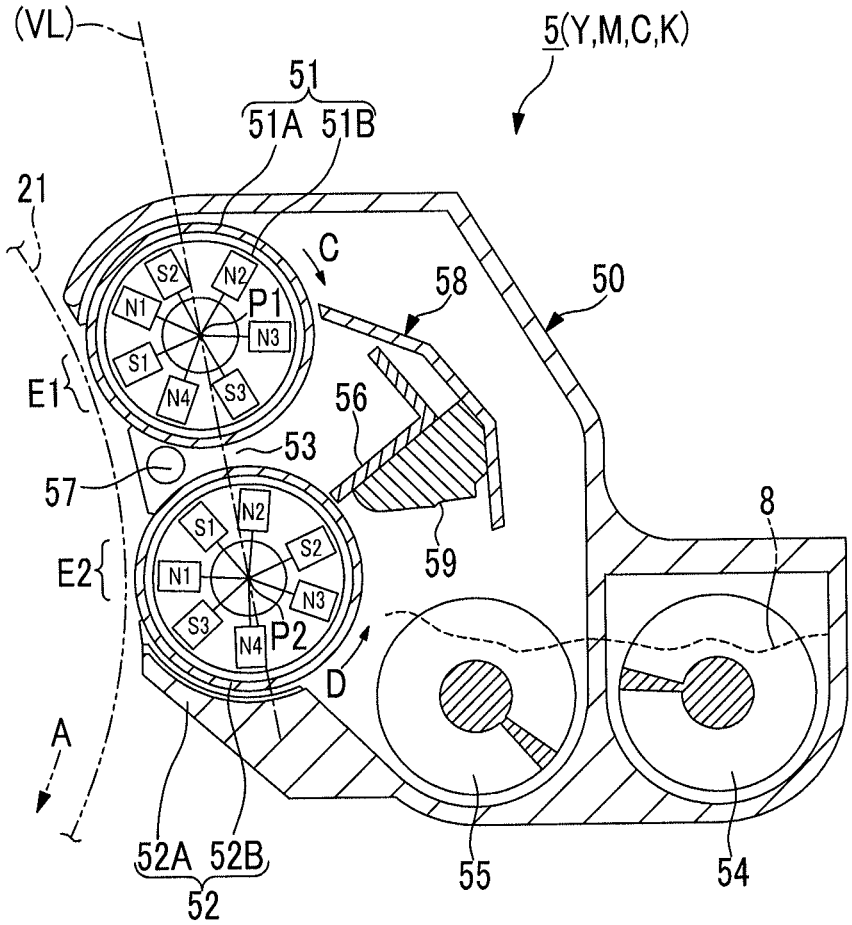
FIG. 5 is a cross-sectional explanatory diagram illustrating principal sections (such as arrangement of magnetic poles of the magnet roller of each developing roller) in the developing device of FIG. 3.

As shown in FIG. 5, each of the magnet rollers 51B and 52B has a structure in which plural magnetic poles (S poles and N poles), generating desired magnetic forces (magnetic force lines) to maintain a state where the magnetic carriers of the two-component developer 8 are formed as a magnetic brush (chain) and generating desired magnetic forces to release the developer from the outer circumferential surface, are disposed on the outer circumferential surface of each of the sleeves 51A and 52A. Both end portions of each of the magnet rollers 51B and 52B are fixedly mounted on the sides of the casing 50 through the inner space of each shaft portion of the developing sleeves 51A and 52A. The plural magnetic poles extend along the axial direction J of the sleeves 51A and 52A, and are disposed at desired positions with distances set in the circumferential direction (rotation direction) of the sleeves 51A and 52A.

In the magnet roller 51B of the first developing roller 51 in Exemplary Embodiment 1, seven magnetic poles of S3, N4, S1, N1, S2, N2, and N3 are disposed. The magnetic pole S3 thereof is a division pole that attracts and shifts the developer 8, which is divided and delivered from the second developing roller 52, toward the first developing roller 51 by the magnetic force. The magnetic pole S1 is a development pole for performing development by bringing the developer 8 in the first development region E1 into contact with the outer circumferential surface of the photoconductor drum 21 in a state where a large magnetic brush is formed. The magnetic poles N4 and N1 are transport assistance poles that are disposed around the development pole S1 as the center thereof so as to assist in transporting the developer 8 in the anterior and posterior areas on the upstream side and downstream side of the sleeve 51A in the rotation direction C. The magnetic pole S2 is a transport pole for holding and transporting the developer 8 after passing through the development region E1. The magnetic poles N2 and N3 are pick-off poles for picking off the developer 8 from the sleeve 51A by generating repulsive magnetic fields from both poles.

In contrast, in the magnet roller 52B of the second developing roller 52, seven magnetic poles of N3, S2, N2, S1, N1, S3, and N4 are disposed. The magnetic pole N3 thereof is a pickup pole for adhering the developer 8, which is supplied from the screw auger 55, onto the sleeve 52A. The magnetic pole S2 is a layer regulation assistance pole for assisting in layer regulation of the layer regulating plate 56. The magnetic pole N2 is a pair of division poles functioning in cooperation with the division pole S3 of the first developing roller 51, and has a function of dividing apart of the developer 8, which is held on the second developing roller 52 after passing the layer regulating plate 56, and delivering the divided developer to the first developing roller 51 side. The magnetic pole N1 is a development pole for performing development by bringing the developer 8 in the second development region E2 into contact with the outer circumferential surface of the photoconductor drum 21 in a state where a large magnetic brush is formed. The magnetic poles S1 and S3 are transport assistance poles that are disposed around the development pole N1 as the center thereof so as to assist in transporting the developer 8 in the anterior and posterior areas on the upstream side and downstream side of the sleeve 52A in the rotation direction D. The magnetic poles N4 and N3 are pick-off (release) poles for picking off the developer 8 from the sleeve 52A by generating repulsive magnetic fields from both poles.

Incidentally, in the developing device 5, the division pole S3 of the first developing roller 51 and the division pole N2 of the second developing roller 52 are disposed to be present in a region opposed to a region in which the photoconductor drum 21 is present when the virtual straight line (VL), connecting the center position P1 of the magnet roller 51B corresponding to the rotation center of the first developing roller 51 and the center position P2 of the magnet roller 52B corresponding to the rotation center of the second developing roller 52, is set as the boundary of the areas, as shown in FIGS. 4A to 4C and the like. More specifically, the division pole S3 and the division pole N2 are disposed such that the central angles formed between the poles and the virtual straight line (VL) connecting the center positions (P1 and P2) of the developing rollers 51 and 52 are, for example, in the range of 10° to 30°.

As shown in FIG. 3 and the like, both the screw augers 54 and 55 have structures each having a spiral shape in which a transport blade is wound around the circumferential surface of the rotation shaft, are rotatably provided to be present in the two-line transport paths respectively in the containing space 50*a* of the main member 50, and are driven to be rotatable in a direction for transporting the respective developers 8 of both the transport paths in a desired direction. The augers 54 and 55 are rotated by dividing and transferring a part of the power rotating the sleeves 51A and 52A of the respective developing rollers 51 and 52 through a driving force transfer mechanism such as a gear. The screw auger 55, which is disposed close to the second developing roller 52, supplies the second developing roller 52 with a part of the developer 8 to be transported.

The layer regulating plate 56 is a substantially rectangular plate member of which the principal section has a length (long side) the same as at least the length of the sleeve 52A of the second developing roller 52 in the axial direction J. Further, the layer regulating plate 56 is formed of a non-magnetic material (for example stainless steel). Furthermore, the layer regulating plate 56 is mounted on the casing 50 such that the one end portion (the lower long side) thereof in the lengthwise direction extends along the axial direction J of the sleeve 52A and faces the outer circumferential surface of the sleeve 52A with a desired distance (layer regulation distance) set.

The leakproof member 57 is a substantially columnar member which has a length extending along the axial direction J of the two developing rollers 51 and 52 and of which the cross-section has a substantially circular shape. The leakproof member 57 is provided at a position closer to the photoconductor drum 21 than the narrowest gap 53 between the two developing rollers 51 and 52 with desired distances set between itself and the outer circumferential surfaces of the sleeves 51A and 52A. Further, the leakproof member 57 is mounted such that the attaching portions projected from both end portions thereof are fixed onto the sides of the main member 50.

The collection guide plate 58 is a plate member that has a surface for receiving the developer released from the first developing roller 51 and thereafter smoothly dropping the developer so as to return the developer to the containing space 50*a*. As shown in FIG. 3 and the like, the collection guide plate 58 is mounted on the supporting member 59 such that the upper end portion 58*a* thereof is opposed to the outer circumferential surface of the sleeve 52A, with a predetermined distance set, at a position between the magnetic pole S2 and the magnetic pole S3 which are the release poles of the first developing roller 51, and such that the lower end portion 58*b* extends to be gradually inclined from the upper end portion 58*a* toward the lower side and finally reaches the position close to the upper side of the screw auger 55.

Basic Operation of Developing Device

Hereinafter, the basic operation of the developing device 5 will be described.

First, in the developing device 5, when an image is formed by the image forming apparatus 1, the screw augers 54 and 55 and the sleeves 51A and 52A of the two developing rollers 51 and 52 begin to be rotated, and developing voltages are applied to the sleeves 51A and 52A.

Thereby, the two-component developer G, which is contained in the containing space 50*a* of the main member 50, is transported along two-line transport paths in the containing space 50*a* in the respective directions while the developer is stirred by the rotating augers 54 and 55, and is thus transported to be entirely circulated. At this time, the non-magnetic toner in the developer 8 is sufficiently agitated with the magnetic carriers so as to be frictionally charged and be electrostatically adhered onto the surface of the carrier.

Figure 6:
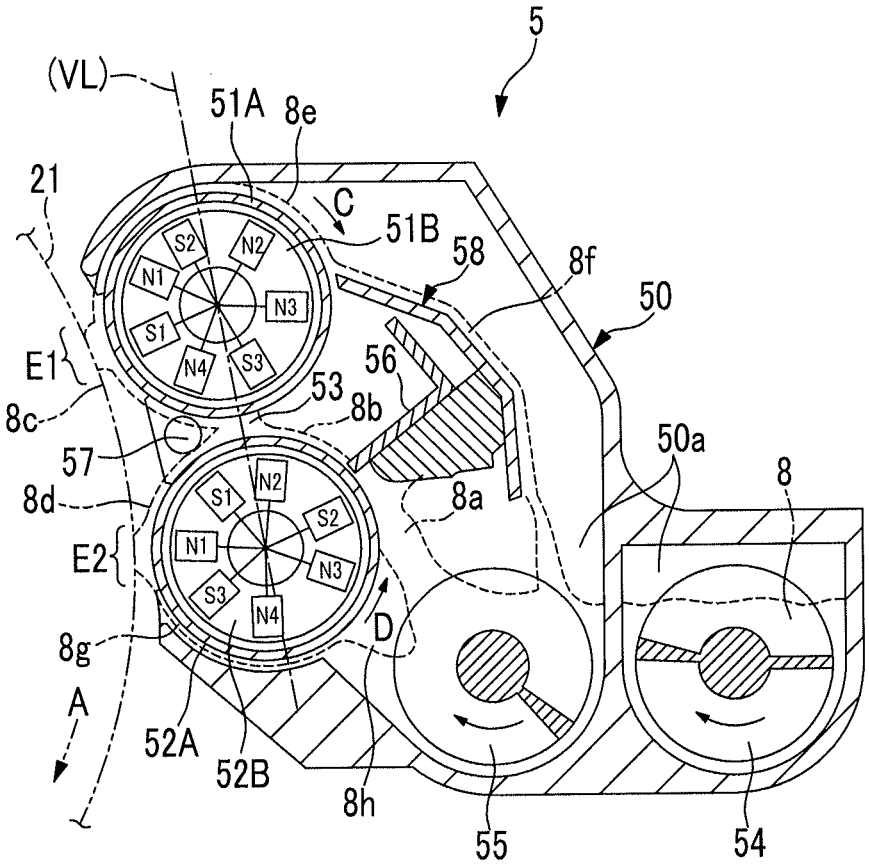
FIG. 6 is an explanatory diagram illustrating a basic operation of the developing device of FIGS. 3 and 5.

Subsequently, a part 8*a* of the two-component developer 8, which is transported by the screw auger 55 disposed in the transport path closer to the second developing roller 52, is held to be adhered, as shown in FIG. 6, onto the outer circumferential surface of the sleeve 52A of the second developing roller 52 by the magnetic force. That is, the part 8*a* is held and supplied in a state where the magnetic brush having a chain shape, in which the magnetic carriers with the toner adhered thereto are connected in chains, is formed by imparting the magnetic force (magnetic force lines), which is generated from the magnetic pole S2 of the magnet roller 52B, to the outer circumferential surface of the rotating sleeve 52A.

Subsequently, developer 8*b*, after passing the layer regulating plate 56, arrives at the gap 53 between the second developing roller 52 and the first developing roller 51. In the gap 53, some carrier particles of the developer 8*b* are connected in chains so as to interconnect both developing rollers 51 and 52 by the magnetic force formed between the division poles N2 and S3 which are disposed to be opposed to (the magnet rollers 51B and 52B of) the two developing rollers 51 and 52 respectively, thereby forming a delivery path in which the carrier particles are moved together with the toner particles from the second developing roller 52 toward the first developing roller 51. Hence, when the developer 8*b* passes in proximity to the gap 53, a part of the developer is separated from the first developing roller 51, and is delivered to the first developing roller 51 through the delivery path. Thereby, the developer 8*b*, which is held on the second developing roller 52 after passing the layer regulating plate 56, is divided (into developers 8*c* and 8*d*) and distributed to the second developing roller 52 and the first developing roller 51 at a desired ratio.

At this time, when developer 8*c* distributed to the first developing roller 51 is transported by the sleeve 51A which is rotated in the direction of the arrow C and passes through the first development region E1 positioned upstream of the photoconductor drum 21 in the rotation direction A, the developer undergoes the magnetic force of the developing magnetic pole S1 and the development field generated by the developing voltage. Thereby, the toner of the magnetic brush of the developer 8*c* is moved back and forth between the roller and the photoconductor drum 21, and is adhered onto the latent image part which passes through the first development region E1, thereby developing the corresponding latent image part.

Finally, the developer 8*e*, after passing through the first development region E1, is transported while the developer is held on the outer circumferential surface of the first developing roller 51 by the magnetic forces of the transport assistance pole N1 and the transport pole S2, and thereafter released from the outer circumferential surface of the sleeve 51A by the repulsive magnetic force formed between the magnetic pole N2 and the magnetic pole N3 which are the release poles. At this time, released developer 8*f* is guided to the collection guide plate 58, and is dropped toward the containing space 50*a*, and apart thereof is returned toward the containing space 50*a*.

Meanwhile, when developer 8*d* distributed to the second developing roller 52 is transported by the sleeve 52A which is rotated in the direction of the arrow D and passes through the second development region E2 positioned downstream of the photoconductor drum 21 in the rotation direction A, the developer undergoes the magnetic force of the developing magnetic pole N1 and the development field generated by the developing voltage. Thereby, the toner of the magnetic brush of the developer 8*d* is moved back and forth between the roller and the photoconductor drum 21, and is adhered onto the latent image part (a latent image part which is developed through the first developing roller 52) which passes through the second development region E2, thereby developing the corresponding latent image part.

Developer 8*g*, after passing through the second development region E2, is transported while the developer is held on the outer circumferential surface of the second developing roller 52 by the magnetic forces of the transport assistance pole S3 and the transport pole N4, and thereafter released from the outer circumferential surface of the sleeve 52A by the repulsive magnetic force formed between the magnetic pole N4 and the magnetic pole N3 which are the release poles. Released developer 8*h* is returned to the containing space 50*a* in a way that the developer is naturally dropped.

Specific Configuration of Developing Device

Further, in the developing device 5, the number N2 of grooves 60 on the second developing roller 52 is set to satisfy the relationship (N2>N1) in which the number N2 is greater than the number N1 of grooves 60 on the first developing roller 51.

With such a configuration, compared with the case of not adopting the configuration (a case where the setting is made such that N2=N1), the following effects can be clearly seen from the results (FIG. 7) of the evaluation test to be described later. In the first developing roller 51, it is possible to stably obtain a characteristic, in which the developer held on the roller is unlikely to be stagnant in a section through which the developer passes in proximity to the latent image carrier, the so-called jamming resistance. In addition, in the second developing roller 52, it is possible to prevent uneven density, corresponding to the groove pitch, the so called groove pitch unevenness from occurring. Incidentally, the number N2 of grooves 60 on the second developing roller 52 may be set to satisfy the relationship (N2<N1) in which the number N2 is less than the number N1 of grooves 60 on the first developing roller 51. In this case, it can be seen that, as N1 becomes large, the stagnation (jamming) of the developer in the first development region E1 is caused by the first developing roller 51, and thereby defects such as a decrease in the density of the developed image and overflow of the developer occurs. Further, it can be seen that, as N2 becomes smaller, occurrence of the groove pitch unevenness becomes more conspicuous. The term "first" in FIG. 7 indicates the first developing roller 51, and the term "second" indicates the second developing roller 52.

The ratio of the number N2 of grooves on the second developing roller 52 to the number N1 of grooves on the first developing roller 51 is changed by different conditions such as the circumferential speed ratios of both developing rollers 51 and 52. However, for example, it is preferable that the number N2 of grooves on the second developing roller 52 be not less than 1.3 times the number N1 of grooves of the first developing roller 51. Further, it is preferable that the cross-sectional shapes of the grooves 60, which are formed on the two developing rollers 51 and 52 respectively, have the same shape typified by the inverted triangle shape (V shape) exemplified in FIG. 4B, an U shape, and the like. However, if the sums of the cross-sectional contents (each of which is a content of a single groove) of the grooves 60 are substantially the same, the cross-section shapes thereof may be different. Incidentally, regarding the cross-sectional shapes of the respective grooves 60 of the respective developing rollers 51 and 52, for example, in terms of stably obtaining a favorable jamming resistance, it is preferable that the shapes be the same. FIG. 4C shows the dimensions of the V-shaped groove (V groove) 60. In FIG. 4C, a reference sign w represents the width of the groove (a dimension of the sleeve in the circumferential direction), a reference sign d represents the depth of the groove, a reference sign θ represents the open angle of the V groove, and a reference sign Pc represents the pitch between the V grooves.

Furthermore, in the developing device 5, in addition to the setting of the groove number relationship (N2>N1), the respective circumferential speed ratios of the first developing roller 51 and the second developing roller 52 to the photoconductor drum 21 and respective computational groove pitches P1c and P2c of the developing rollers 51 and 52 described as follows are set on the basis of the various conditions as shown in FIG. 7.

P1c=the groove pitch on the first developing roller/the circumferential speed ratio=(the circumferential length of the first developing roller/the number of grooves)/(the circumferential speed of the first developing roller/the circumferential speed of the photoconductor drum)

P2c=the groove pitch on the second developing roller/the circumferential speed ratio=(the circumferential length of the second developing roller/the number of grooves)/(the circumferential speed of the second developing roller/the circumferential speed of the photoconductor drum)

Incidentally, the circumferential speed (mm/s) is calculated by the expression of "$2\pi R\times(n/60)$". In the expression, n represents the number of rotations (rpm), R represents the radius (mm) of the developing roller (sleeve) or the photoconductor drum, and 60 represents seconds (s). Further, the circumferential length is the circumferential length ($2\pi R$) of the sleeve of each developing roller.

Evaluation Test

Hereinafter, the evaluation test performed by using the developing device 5 will be described.

In the evaluation test, the developing device 5 that is set on the basis of various conditions of the numbers of grooves 60 of the two developing rollers 51 and 52, the circumferential speed ratios of the rollers to the photoconductor drum 21, and the computational groove pitches thereof as shown in FIG. 7 (the developing device 5 includes a developing device as a comparative example which does not satisfy the condition of N2>N1), is manufactured, and is mounted on the image forming apparatus 1 as necessary. Then, plural characteristics (the jamming resistance and the developing ability of the first developing roller 51, the groove pitch unevenness of the second developing roller 52, the smoothing effect, and the trimmer stress) of the developing devices are examined. The test results are additionally shown in FIG. 7.

The developing device 5 used herein includes: the sleeves 51A and 52A in which the diameters (outer diameters) of the first developing roller 51 and second developing roller 52 are equal to about 25 mm and the roller (effective development area) lengths are equal to about 330 mm; and the magnet rollers 51B and 52B which have the magnetic poles (the magnetic flux density of the developing magnetic pole S1 is about 130 mT, and the magnetic flux density of the developing magnetic pole N1 is about 130 mT). When 100 grooves are formed, each groove 60 formed on the developing rollers 51 and 52 is a V groove of which the dimensions are the width w of about 287 μm the depth d of about 85 μm and the open angle θ of about 95°. When 130 grooves are formed, each groove 60 is a V groove of which the dimensions are the width w of about 250 μm, the depth d of about 74 μm, and the open angle θ of about 95°. When 160 grooves are formed, each groove 60 is a V groove of which the dimensions are the width w of about 226 μm, the depth d of about 67 μm, and the open angle θ of about 95°. Regarding each width w, there is some variation in the edge portions of the V grooves, and thus the width is measured at a part which is about 80% of the depth of the deepest part higher than the deepest part of each V groove. Further, the circumferential speed of each of the developing rollers 51 and 52 is set to three circumferential speeds of about 950 mm/s, about 792 mm/s, and about 633 mm/s. Furthermore, the distance α1 between the first developing roller 51 and the photoconductor drum 21 is set to about 220 μm, and the distance α2 between the second developing roller 52 and the photoconductor drum 21 is set to about 220 μm. In addition, the gap δ between the two developing rollers 51 and 52 is set to about 4 mm.

Meanwhile, as the photoconductor drum 21 in the image forming apparatus 1, a photoconductor drum, in which a functional-separation-type organic photosensitive layer is provided on the circumferential surface of the substantially cylindrical base member and of which the diameter is about 84 mm, is used, and is rotated at a circumferential speed of about 528 mm/s. Further, the developing device 5 is supplied with the developing voltage as necessary, and is supplied with for example a voltage of about 500V at the time of forming a test image. As the two-component developer 8, a two-component developer, which includes a non-magnetic toner that is made of polyester resin and has an average particle diameter of 3.8 μm and magnetic carrier particles that is made of ferrite core and has an average particle diameter of 25 μm, is used.

Regarding the jamming resistance of the evaluation items, the first developing rollers 51, of which the numbers of V grooves 60 are different, are rotated, in a state where the rollers hold the two-component developer 8 by the volume of developer held per unit area (MOS) of about 300 g/m$^2$ and are supplied with a voltage of about 500V as the developing voltage, on conditions that the circumferential speed ratios of rollers to the photoconductor drum 21 are set to 1.8, 1.5, and 1.2. At this time, it is examined whether or not the developer 8 held on the first developing roller 51 is stagnant in the first development region E1 through which the developer passes in proximity to the photoconductor drum 21. The results at that time are evaluated by the following criteria.

○: The developer is not stagnant.

Δ: A sign of stagnation of the developer can be observed.

X: The developer is stagnant.

Regarding the groove pitch unevenness of the evaluation items, when image formation is performed by developing test images (halftone image of 40 to 50%) of the developing devices corresponding to the respective settings, it is examined whether or not each obtained image has uneven density (groove pitch unevenness) in which the different density lines are arranged in parallel with distances set in the rotation direction in a line shape (striped shape) along the axial direction J of the second developing roller 52 (photoconductor drum 21). The results at that time are evaluated by the following criteria.

○: The uneven density is not observed.

X: The uneven density is observed.

Regarding the developing ability of the evaluation items, when development is performed by the first developing roller 51 of which the circumferential speed ratio is about 1.2 with the number of grooves of 160, the total charge amount (calculated DQA) at which development can be performed in a fixed development field (for example, in a case where the developing voltage of about −500V is applied) is calculated as a relative value to a reference value which is set to "1.00". The calculated DQA can be calculated by the expression of the developer weight per unit area (g/mm$^2$)×the charge amount of the developed toner (μC/g). The calculated value indicates that, as the numerical value becomes larger, the developing ability (developing performance) becomes more favorable. Further, the relative value indicates that, as the relative value becomes larger than 1.00 as the reference value, the developing ability becomes more favorable.

Regarding the smoothing effect of the evaluation items, when image formation is performed by developing plural patch images (image area coverage: about 20 to 70%) each having a substantially rectangular shape, a situation of the density at the tailing end portion of each patch image is examined. The density is determined by comparing each observed image with a boundary sample which is produced in advance. The results at that time are evaluated by the following criteria.

○: The change in density is minor (in an allowable range).

X: The change in density (density difference) is large.

Regarding the trimmer stress of the evaluation items, examination is performed in a way of observing conditions, in which external additives are embedded on the surfaces of the toner particles in the developer 8 which is held on the second developing roller 52 and passes the layer regulating plate 56, through a scanning electron microscope (SEM). The results at that time are evaluated in a way of comparing with samples which are produced in advance and are graded in accordance with the embedded conditions, on the basis of the following criteria.

○: The condition is substantially the same as that of a grade in which the additives are mostly not embedded.

Δ: The condition is substantially the same as that of a grade in which some additives are embedded.

X: The condition is substantially the same as that of a grade in which the additives are mostly embedded.

First, as can be seen from the result shown in FIG. 7, in the developing device 5, when the number N2 of grooves 60 on the second developing roller 52 is set to satisfy the relationship (N2>N1) in which the number N2 is greater than the number N1 of grooves 60 on the first developing roller 51, it is possible to stably obtain the jamming resistance on the first developing roller 51, and it is possible to prevent groove pitch unevenness from occurring on the second developing roller 52.

Further, in the developing device 5, in addition to the setting of the number of grooves, the computational groove pitch P2c of the second developing roller 52 may be set to satisfy a condition represented by "P2c<0.50". In this case, it can be seen that it is possible to stably obtain the jamming resistance on the first developing roller 51, and it is possible to reliably prevent groove pitch unevenness from occurring on the second developing roller 52.

Further, in the developing device 5, in addition to at least the setting of the number of grooves and the like, the computational groove pitch P1c of the first developing roller 51 and the computational groove pitch P2c of the second developing roller 52 may be set to satisfy a condition represented by "P1c>P2c". In this case, it can be seen that it is possible to stably obtain the jamming resistance on the first developing roller 51 and it is possible to reliably obtain the smoothing effect of the second developing roller 52 while preventing groove pitch unevenness from occurring on the second developing roller 52. Further, the respective rotation directions of the first developing roller 51 and the second developing roller 52 may be set as the direction exemplified in Exemplary Embodiment 1, relative to the rotation direction of the photoconductor drum 21. In this case, in addition to the above-mentioned effects, it is possible to reliably obtain the smoothing effect that suppress occurrence of the change in density at the tailing end portion of the image on the second developing roller 52.

Furthermore, in the developing device 5, in addition to at least the setting of the number of grooves and the like, the circumferential speed ratio of the first developing roller 51 may be set to be greater than about 1.2. In this case, it can be seen that the developing ability of the first developing roller 51 is further improved.

Further, in the developing device 5, the first developing roller 51 is rotated such that the movement direction of the section (first development region E1) thereof close to the photoconductor drum 21 is the reverse (the direction indicated by the arrow C) of that of the photoconductor drum 21, the second developing roller 52 is rotated such that the movement direction of the section (second development region E2) thereof close to the photoconductor drum 21 is the same (the direction indicated by the arrow D) as that of the photoconductor drum 21, and the layer regulating plate 56 is disposed above the outer circumferential surface of the second developing roller 52. In this case, the rotation direction of the first developing roller 51 is the reverse of the rotation direction of the photoconductor drum 21. Hence, although the developer tends to be stagnant in the section thereof (first development region E1) close to the photoconductor drum 21 of the first developing roller 51, it can be seen that it is possible to stably obtain the jamming resistance on the first developing roller 51, and it is possible to prevent groove pitch unevenness from occurring on the second developing roller 52.

Finally, regarding the trimmer stress, it can be seen that only the magnitude of the circumferential speed of the second developing roller 52 has an effect on the results thereof, regardless of the configuration of the number of grooves, the circumferential speed ratio (excluding the circumferential speed ratio of the second developing roller 52), the computational groove pitch, and the like. That is, as the circumferential speed (rotation speed) of the second developing roller 52 decreases, the results of the trimmer stress become better.

Next, in the evaluation test, the results of the test, relating to the relationship of characteristics, performed by using several exemplary configurations of the developing devices 5 will be described. The respective configurations of the developing devices 5 are set to a condition for the test unless otherwise noted.

Figure 8:
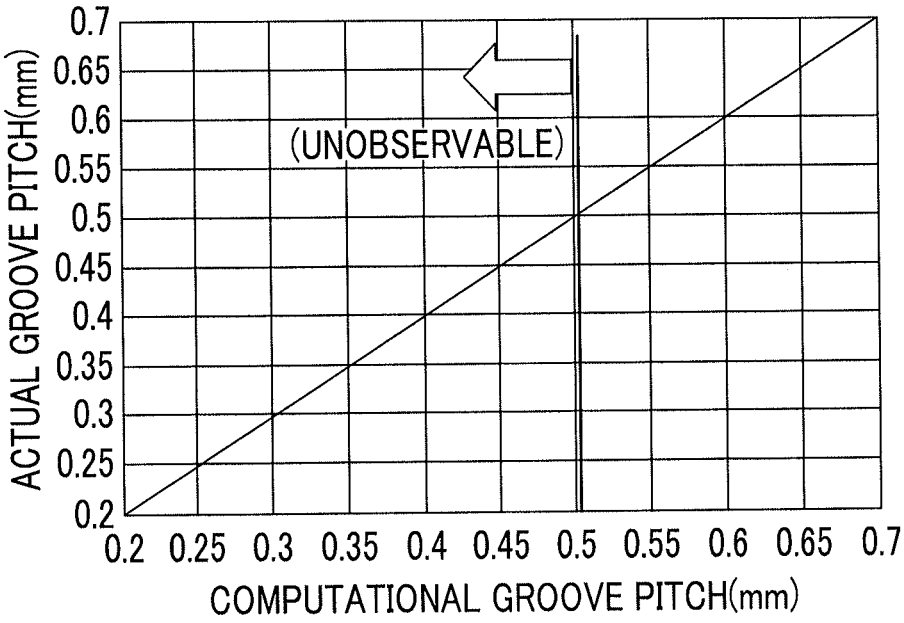

First, FIG. 8 shows a result obtained when examining the relationships between the computational groove pitch and the actual groove pitch of the developing roller 51 or 52.

The actual groove pitch is a numerical value obtained when the density of the obtained image is read in the transport direction of the printing paper 9 and the frequency analysis is performed. The density of the image is obtained when image formation is performed by developing the test images (overall halftone image: image area coverage=about 30 to 70%) through the respective developing rollers 51 and 52 at various groove pitches based on calculation. From the result shown in FIG. 8, it can be clearly observed that the computational groove pitch is correlated (consistent) with the actual groove pitch. Further, it is difficult to observe the groove pitch unevenness when the computational groove pitch is less than about 0.50 mm. Hence, the drawing shows the heavy line and the bold arrow indicating the boundary which is unlikely to be observed.

Figure 9:
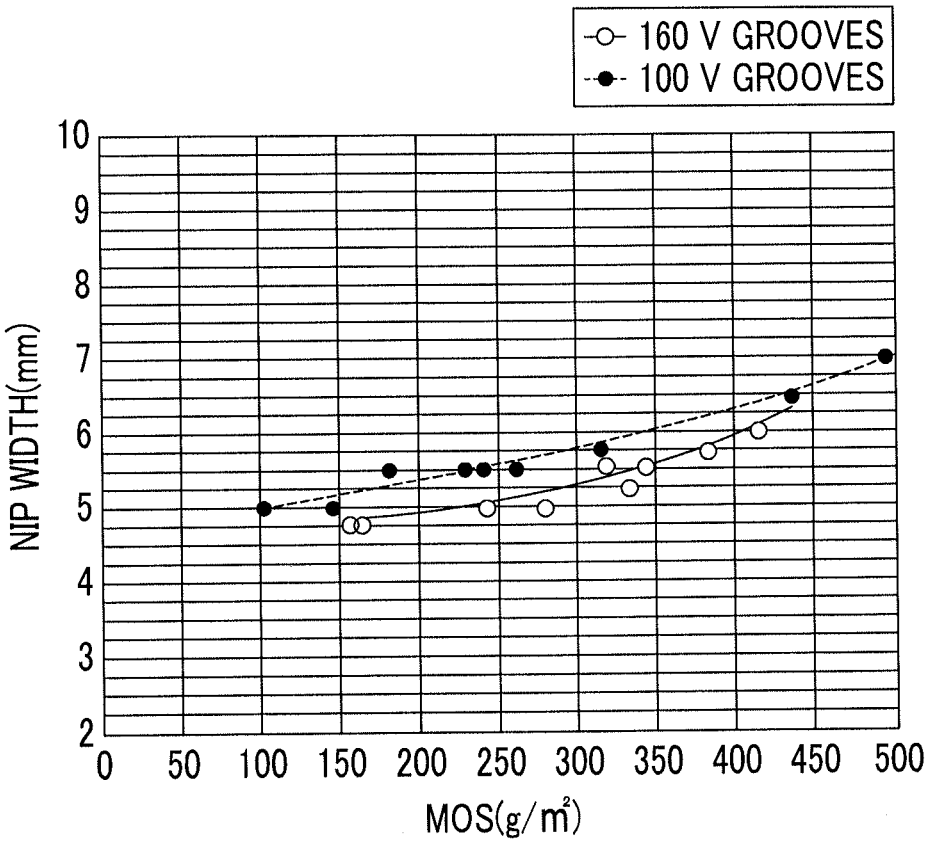
FIG. 9 is a graph illustrating results obtained when examining the relationships between the MOS and the nip width of the first developing rollers.

FIG. 9 shows the results obtained when examining the relationships between the nip widths of the developer in the first development region E1, which is opposed and close to the photoconductor drum 21, and the volumes of developer held per unit area (MOS: $g/m^2$) on the respective first developing rollers 51 at the number of grooves 60 of 160 or 100.

The value of MOS is adjusted by changing the distance of the gap (regulating gap) between the layer regulating plate 56 and the second developing roller 52. Regarding the nip width, a width (the dimension of the photoconductor drum 21 along the rotation direction A) of a band-like developer image (toner band) developed on the photoconductor drum 21 is measured when the developing voltage is supplied between the first developing roller 51 and the photoconductor drum 21 which are stationary. From the result shown in FIG. 9, the following relationship can be clearly observed. In the first developing roller 51, it is possible to form a larger nip width at the same MOS as the number of grooves 60 is smaller (in the case, the number is 100). That is, in the first developing roller 51, it is possible to increase the width (the dimension of the area of the photoconductor drum 21 along the rotation direction A) of the first development region E1 as the number of grooves formed on the roller decreases. This leads to a favorable developing ability.

Figure 10:
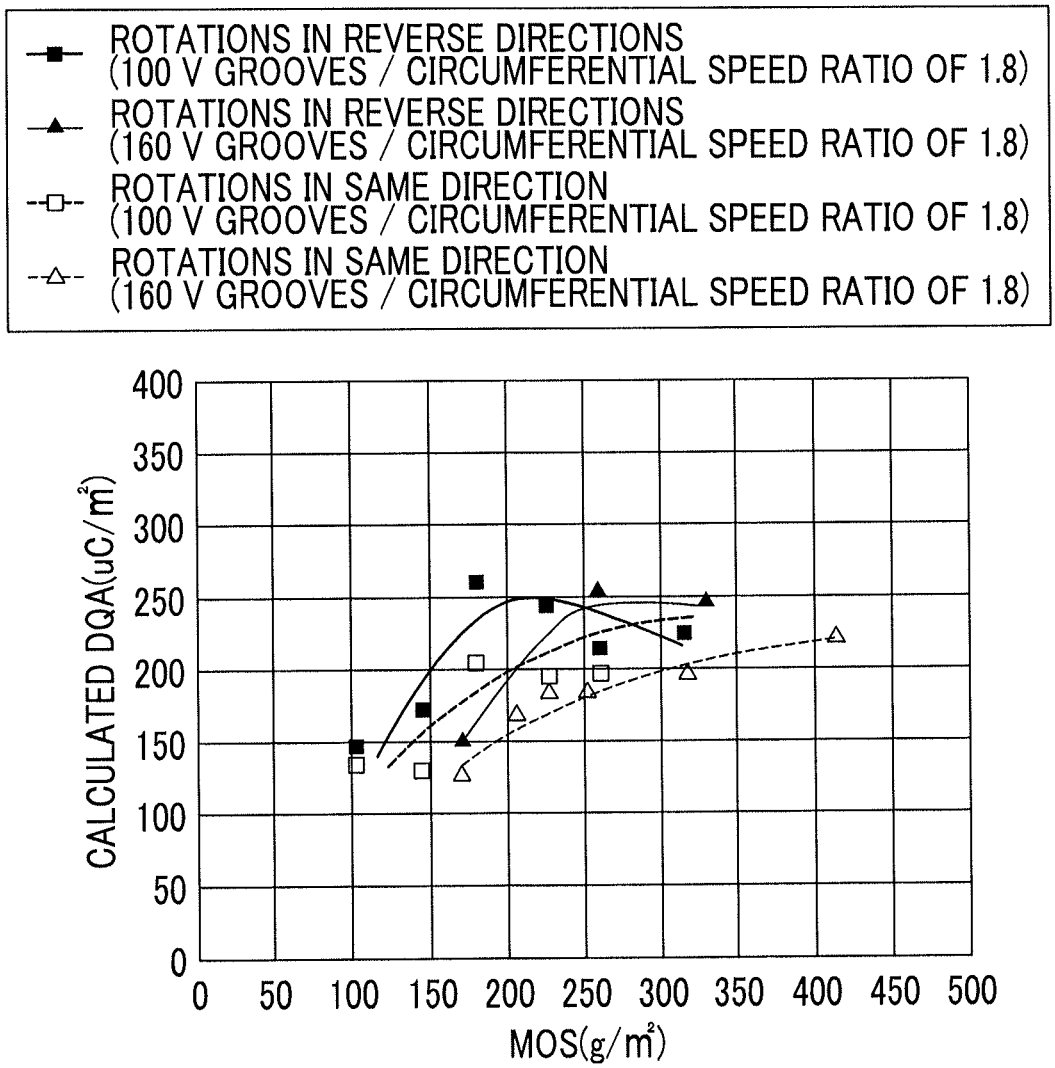
FIG. 10 is a graph illustrating results obtained when examining the relationships between the MOS and the calculated DQA of the first developing rollers of which the rotation directions are different.

FIG. 10 shows the results obtained when examining the relationships between the total charge amounts (calculated DQA), which can be developed in the fixed development field, and the volumes of developer held (MOS) on the respective first developing rollers 51 at the number of grooves 60 of 160 or 100.

Here, the solid line indicates the results which are obtained when the first developing roller 51 is rotated in a direction (the direction exemplified by the arrow C in FIG. 3 and the like) that is the reverse of the rotational movement direction of the photoconductor drum 21. In addition, the dotted line indicates the results which are obtained when the first developing roller 51 is rotated in a direction (the direction exemplified by the arrow D in FIG. 3 and the like) the same as the rotational movement direction of the photoconductor drum 21. From the result shown in FIG. 10, the following relationship can be clearly observed: the calculated DQA increases at the same MOS as the number of grooves 60 decreases (in the case, the number is 100) until the MOS reaches 250 g/m$^2$ regardless of the rotation direction of the first developing roller 51. That is, the developing ability becomes favorable. Further, the following relationship can be also observed: the calculated DQA increases at the same MOS in a case where the rotation directions are the reverse compared with the case where the rotation directions are the same.

Figure 11A:
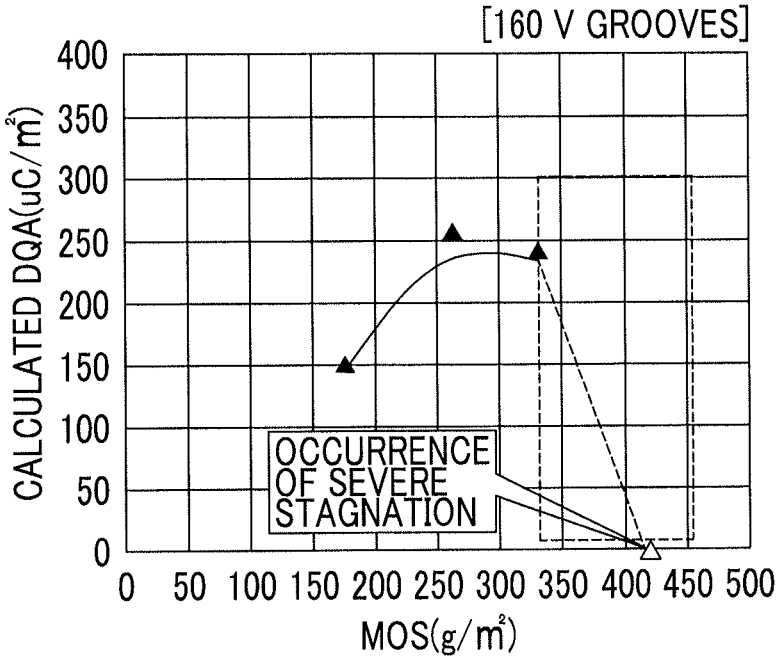
FIGS. 11A and 11B are graphs illustrating situations, in which stagnation occurs, and results obtained when examining the relationships between the MOS and the calculated DQA of the first developing rollers, of which the rotation directions are reversed, for the different numbers of grooves.
Figure 11B:
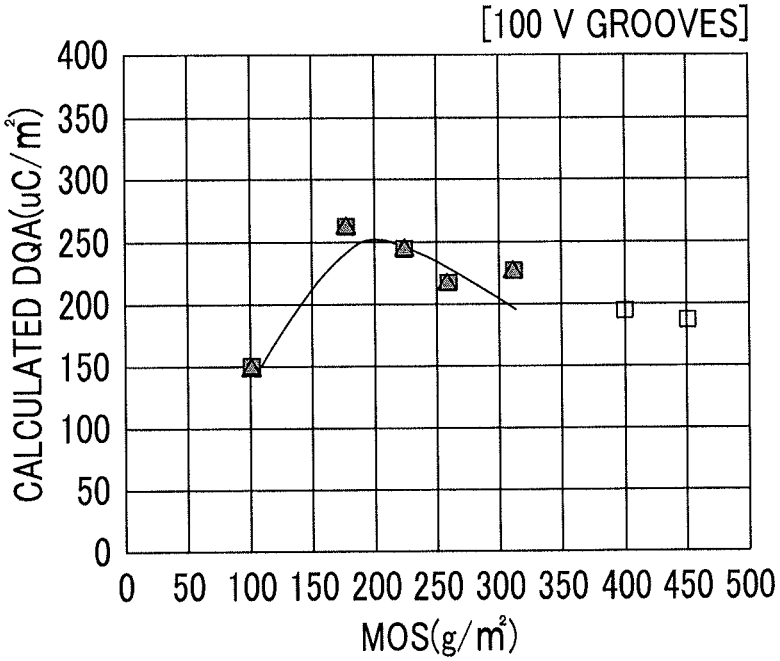

FIGS. 11A and 11B show relationships between the jamming resistance and the results obtained when the rotation directions are the reverse as shown in FIG. 10. FIG. 11A shows the result obtained when the number of grooves 60 is 160. FIG. 11B shows the result obtained when the number of grooves 60 is 100.

From the result shown in FIG. 11A, the following relationship can be clearly observed. When the number of grooves 60 on the first developing roller 51 is 160, the developer 8 is stagnant in the first development region E1 if the MOS is greater than about 350 g/m$^2$, and thus the calculated DQA is not obtained. In contrast, when the number of grooves 60 on the first developing roller 51 is 100, it can be observed that the developer 8 is not stagnant in the first development region E1 even if the MOS is greater than about 350 g/m$^2$ (even if it is 400 g/m$^2$ or 450 g/m$^2$). In addition, in FIG. 11B, values of the calculated DQA obtained when the MOS is greater than about 350 g/m$^2$, which are estimated just for reference, are indicated by the reference signs of the outlined rectangles □.

Other Exemplary Embodiment

Exemplary Embodiment 1 described an example of the configuration of the developing device 5 in which the first developing roller 51 is rotated in the direction D the reverse of the rotational movement direction of the photoconductor drum 21 and the layer regulating plate 56 is provided around the second developing roller 52. However, the developing device, to which the invention is applied, may have the following configuration. For example, the first developing roller 51 may be rotated in the direction C the same as the rotational movement direction of the photoconductor drum 21, and instead of the layer regulating plate 56 disposed around the second developing roller 52, the layer regulating plate 56 may be disposed around the developing roller 51.

Otherwise, regarding the image forming apparatus 1 using the developing device according to the exemplary embodiment of the invention, the type thereof is not particularly limited if it is able to use the developing device, and an image forming apparatus having a different configuration of the related art may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developing roller that is disposed to be rotatable with a desired distance set between the first developing roller and an outer circumferential surface of a rotatable latent image holding member, transports a developer onto an outer circumferential surface thereof, on which a plurality of grooves extend in a direction parallel to an axial direction of the first developing roller, while holding the developer by magnetic force, and has a substantially cylindrical shape, each of the grooves extends from an extreme left end to an extreme right end, and parallel to an axis of the first developing roller; and a second developing roller that is disposed to be rotatable with desired distances set between the second developing roller and the respective outer circumferential surfaces of the corresponding latent image holding member and the corresponding first developing roller at a position on the downstream side of the first developing roller in a rotation direction of the latent image holding member, transports the developer onto an outer circumferential surface thereof, on which a plurality of grooves extending in a direction parallel to an axial direction thereof are formed, while holding the developer by magnetic force, and has a substantially cylindrical shape, wherein the number of grooves on the second developing roller is not less than 1.3 times the number of grooves on the first developing roller.

2. The developing device according to claim 1, wherein a computational groove pitch P2c of the second developing roller is set to satisfy a condition represented as follows:

$$P2c<0.50,$$

where P2c=the groove pitch on the second developing roller/a circumferential speed ratio=(a circumferential length of the second developing roller/the number of grooves)/(a circumferential speed of the second developing roller/a circumferential speed of the latent image holding member).

3. The developing device according to claim 2, wherein a computational groove pitch P1c of the first developing roller and the computational groove pitch P2c of the second developing roller are set to satisfy a condition represented as follows:

$$P1c>P2c,$$

where P1c=the groove pitch on the first developing roller/a circumferential speed ratio=(a circumferential length of the first developing roller/the number of grooves)/(a circumferential speed of the first developing roller/a circumferential speed of the latent image holding member).

4. The developing device according to claim 3, wherein the circumferential speed ratio of the first developing roller (a circumferential speed of the first developing roller/a circumferential speed of the latent image holding member) is set to be greater than about 1.2.

5. The developing device according to claim 4, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

6. The developing device according to claim 3, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

7. The developing device according to claim 2, wherein the circumferential speed ratio of the first developing roller (a circumferential speed of the first developing roller/a circumferential speed of the latent image holding member) is set to be greater than about 1.2.

8. The developing device according to claim 7, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

9. The developing device according to claim 2, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

10. An image forming apparatus comprising:

a rotatable latent image holding member; and the developing device according to claim 2 that develops a latent image by supplying a developer to the latent image holding member.

11. The developing device according to claim 1, wherein the circumferential speed ratio of the first developing roller (a circumferential speed of the first developing roller/a circumferential speed of the latent image holding member) is set to be greater than about 1.2.

12. The developing device according to claim 11, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

13. The developing device according to claim 1, further comprising:

an adjustment member that is fixedly disposed with a desired distance set between the adjustment member and the outer circumferential surface of the second developing roller, and adjusts the volume of the held developer by regulating passage of the developer which is held on the outer circumferential surface of the corresponding second developing roller, wherein the first developing roller is rotated such that a movement direction of a section thereof close to the latent image holding member is the reverse of a movement direction of the corresponding latent image holding member, and wherein the second developing roller is rotated such that a movement direction of a section thereof close to the latent image holding member is the same as the movement direction of the corresponding latent image holding member.

14. An image forming apparatus comprising:

a rotatable latent image holding member; and the developing device according to claim 1 that develops a latent image by supplying a developer to the latent image holding member.

* * * * *